US010401040B2

(12) United States Patent
Kim et al.

(10) Patent No.: US 10,401,040 B2
(45) Date of Patent: Sep. 3, 2019

(54) AIR CONDITIONER

(71) Applicant: Samsung Electronics Co., Ltd., Suwon-si, Gyeonggi-do (KR)

(72) Inventors: Kyung Hoon Kim, Suwon-si (KR); Hooi Joong Kim, Yongin-si (KR); Sung-June Cho, Suwon-si (KR); Kwon Jin Kim, Suwon-si (KR); Se-Hoon Shin, Suwon-si (KR); Joon-Ho Yoon, Suwon-si (KR); Yeon-Seob Yun, Hwaseong-si (KR); Heung Seob Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/871,877

(22) Filed: Jan. 15, 2018

(65) Prior Publication Data

US 2018/0274797 A1 Sep. 27, 2018

(30) Foreign Application Priority Data

Mar. 21, 2017 (KR) ..... 10-2017-0035151

(51) Int. Cl.
*F24F 13/02* (2006.01)
*F24F 13/20* (2006.01)
(Continued)

(52) U.S. Cl.
CPC ..... *F24F 1/0022* (2013.01); *F24F 1/0014* (2013.01); *F24F 1/0033* (2013.01);
(Continued)

(58) Field of Classification Search
CPC ..... F24F 1/0022; F24F 13/222; F24F 13/20; F24F 1/0033; F24F 2001/0037; F24F 2013/205; F24F 2001/0048
See application file for complete search history.

(56) References Cited

U.S. PATENT DOCUMENTS 5,348,563 A * 9/1994 Davis ..... F24F 3/1603 55/385.2
6,250,373 B1 * 6/2001 Vecchi ..... F24F 1/0007 165/125
(Continued)

FOREIGN PATENT DOCUMENTS

EP 1726890 A1 11/2006
EP 1816407 A2 8/2007
(Continued)

OTHER PUBLICATIONS

European Search Report dated Jul. 23, 2018 in connection with European Patent Application No. 18 15 5614, 7 pages.

*Primary Examiner* — Kun Kai Ma

(57) ABSTRACT

Disclosed herein is an air conditioner. The air conditioner includes a housing including an inlet and an outlet; an discharge duct connected to the outlet, and configured to guide air discharged from the outlet to an indoor space, a blow fan assembly disposed in the inside of the housing such that a rotating shaft of the blow fan assembly extends in a vertical direction, and configured to inhale air in the vertical direction in which the rotating shaft extends and to discharge the air in a radial direction, and a heat exchanger extending along a part of a circumference of the blow fan assembly, and including a bending portion.

18 Claims, 9 Drawing Sheets

(51) Int. Cl.

| | |
|---|---|
| ***F24F 13/22*** | (2006.01) |
| ***F24F 1/0014*** | (2019.01) |
| ***F24F 1/0022*** | (2019.01) |
| ***F24F 1/0033*** | (2019.01) |
| ***F24F 1/0047*** | (2019.01) |
| ***F24F 1/0057*** | (2019.01) |

(52) U.S. Cl.

CPC ..... *F24F 1/0047* (2019.02); *F24F 1/0057* (2019.02); *F24F 13/0272* (2013.01); *F24F 13/20* (2013.01); *F24F 13/222* (2013.01); *F24F 2013/205* (2013.01)

(56) References Cited

U.S. PATENT DOCUMENTS

| | | | | |
|---|---|---|---|---|
| 6,718,787 | B1 * | 4/2004 | Hille | B60H 1/00371 62/279 |
| 7,322,401 | B2 * | 1/2008 | Kim | F24F 1/00 165/104.21 |
| 7,497,246 | B2 * | 3/2009 | Sakashita | F24F 1/0011 165/53 |
| 7,591,633 | B2 * | 9/2009 | Hancock | F04D 29/4226 415/206 |
| 9,322,561 | B2 * | 4/2016 | Ikeda | F24F 1/0014 |
| 9,506,661 | B2 * | 11/2016 | Yamada | F24F 1/0007 |
| 9,574,815 | B2 * | 2/2017 | Ikeda | F24F 1/0014 |
| 2004/0253098 | A1 * | 12/2004 | Hancock | F04D 17/02 415/206 |
| 2005/0191174 | A1 * | 9/2005 | Zeng | F04D 17/025 415/206 |
| 2006/0254304 | A1 * | 11/2006 | Nacenta Anmella | F24F 1/0007 62/419 |
| 2011/0058938 | A1 * | 3/2011 | Chen | F04D 29/4226 415/206 |
| 2013/0315731 | A1 * | 11/2013 | Yang | F04D 25/088 416/5 |
| 2014/0286800 | A1 * | 9/2014 | Jeon | F04D 29/283 417/321 |
| 2015/0117034 | A1 * | 4/2015 | Horng | F24F 13/078 362/373 |
| 2016/0369811 | A1 * | 12/2016 | Ling | F04D 29/282 |
| 2017/0051749 | A1 * | 2/2017 | Cho | F04D 25/08 |
| 2018/0142906 | A1 * | 5/2018 | Wu | F24F 1/0022 |

FOREIGN PATENT DOCUMENTS

| | | | | | |
|---|---|---|---|---|---|
| EP | 2587175 | A1 | | 5/2013 | |
| GB | 2344878 | A | | 6/2000 | |
| JP | S5535872 | A | | 3/1980 | |
| JP | 08289504 | A | * | 11/1996 | |
| JP | 2000046360 | A | * | 2/2000 | F24F 1/0007 |
| JP | 2000179924 | A | * | 6/2000 | F24F 1/0007 |
| KR | 2003-0037554 | A | | 5/2003 | |
| KR | 10-2004-0048192 | A | | 6/2004 | |
| KR | 10-2005-0021045 | A | | 3/2005 | |
| KR | 10-2005-0021120 | A | | 3/2005 | |
| KR | 10-2005-0021610 | A | | 3/2005 | |
| KR | 10-2005-0022178 | A | | 3/2005 | |
| KR | 10-2005-0030928 | A | | 3/2005 | |
| KR | 10-2005-0032883 | A | | 4/2005 | |
| KR | 10-2005-0033152 | A | | 4/2005 | |
| KR | 10-2005-0035216 | A | | 4/2005 | |
| KR | 10-2005-0040349 | A | | 5/2005 | |
| KR | 10-2005-0043332 | A | | 5/2005 | |
| KR | 10-2005-0061095 | A | | 6/2005 | |
| KR | 10-2005-0061676 | A | | 6/2005 | |
| KR | 10-2005-0064188 | A | | 6/2005 | |
| KR | 10-2005-0064963 | A | | 6/2005 | |
| KR | 10-2005-0065780 | A | | 6/2005 | |
| KR | 10-2005-0078879 | A | | 8/2005 | |
| KR | 10-2005-0083095 | A | | 8/2005 | |
| KR | 10-2005-0083412 | A | | 8/2005 | |
| KR | 10-2005-0083414 | A | | 8/2005 | |
| KR | 10-2005-0087503 | A | | 8/2005 | |
| KR | 10-2005-0090853 | A | | 9/2005 | |
| KR | 10-2005-0091416 | A | | 9/2005 | |
| KR | 10-2005-0098641 | A | | 10/2005 | |
| KR | 10-2005-0102904 | A | | 10/2005 | |
| KR | 10-2005-0105644 | A | | 11/2005 | |
| KR | 10-2005-0105714 | A | | 11/2005 | |
| KR | 10-2005-0109782 | A | | 11/2005 | |
| KR | 10-2005-0111962 | A | | 11/2005 | |
| KR | 10-2005-0117740 | A | | 12/2005 | |
| KR | 10-2005-0120472 | A | | 12/2005 | |
| KR | 10-2006-0016331 | A | | 2/2006 | |
| KR | 10-2006-0019385 | A | | 3/2006 | |
| KR | 10-2006-0022541 | A | | 3/2006 | |
| KR | 10-2006-0033432 | A | | 4/2006 | |
| KR | 10-2006-0035429 | A | | 4/2006 | |
| KR | 10-2006-0035431 | A | | 4/2006 | |
| KR | 10-2006-0037131 | A | | 5/2006 | |
| KR | 10-2006-0041070 | A | | 5/2006 | |
| KR | 10-2006-0058230 | A | | 5/2006 | |
| KR | 10-2006-0069693 | A | | 6/2006 | |
| KR | 10-2006-0071477 | A | | 6/2006 | |
| KR | 10-2006-0076555 | A | | 7/2006 | |
| KR | 10-2006-0115486 | A | | 11/2006 | |
| KR | 10-2006-0119450 | A | | 11/2006 | |
| KR | 10-2006-0132170 | A | | 12/2006 | |
| KR | 10-2007-0005194 | A | | 1/2007 | |
| KR | 10-2007-0006146 | A | | 1/2007 | |
| KR | 10-2007-0011775 | A | | 1/2007 | |
| KR | 10-2007-0012034 | A | | 1/2007 | |
| KR | 10-2007-0025282 | A | | 3/2007 | |
| KR | 10-2007-0032865 | A | | 3/2007 | |
| KR | 10-2007-0036763 | A | | 4/2007 | |
| KR | 10-2007-0049710 | A | | 5/2007 | |
| KR | 10-2007-0049893 | A | | 5/2007 | |
| KR | 10-2007-0053950 | A | | 5/2007 | |
| KR | 10-2007-0066393 | A | | 6/2007 | |
| KR | 10-2007-0067409 | A | | 6/2007 | |
| KR | 10-2007-0068568 | A | | 7/2007 | |
| KR | 10-2007-0068569 | A | | 7/2007 | |
| KR | 10-2007-0107401 | A | | 11/2007 | |
| KR | 10-2007-0111693 | A | | 11/2007 | |
| KR | 10-0779667 | B1 | | 11/2007 | |
| KR | 10-0787920 | B1 | | 12/2007 | |
| KR | 10-2008-0003748 | A | | 1/2008 | |
| KR | 10-0791448 | B1 | | 1/2008 | |
| KR | 10-2008-0013799 | A | | 2/2008 | |
| KR | 10-0805074 | B1 | | 2/2008 | |
| KR | 10-2008-0023416 | A | | 3/2008 | |
| KR | 10-2008-0025837 | A | | 3/2008 | |
| KR | 10-2008-0026816 | A | | 3/2008 | |
| KR | 10-0815125 | B1 | | 3/2008 | |
| KR | 10-2008-0033040 | A | | 4/2008 | |
| KR | 10-2008-0037316 | A | | 4/2008 | |
| KR | 10-0820915 | B1 | | 4/2008 | |
| KR | 10-2008-0038904 | A | | 5/2008 | |
| KR | 10-2008-0039603 | A | | 5/2008 | |
| KR | 10-2008-0043917 | A | | 5/2008 | |
| KR | 10-2008-0044051 | A | | 5/2008 | |
| KR | 10-0848305 | B1 | | 7/2008 | |
| KR | 10-0859174 | B1 | | 9/2008 | |
| KR | 10-0865742 | B1 | | 10/2008 | |
| KR | 10-2008-0101354 | A | | 11/2008 | |
| KR | 10-2008-0103037 | A | | 11/2008 | |
| KR | 10-0870409 | B1 | | 11/2008 | |
| KR | 10-2008-0108708 | A | | 12/2008 | |
| KR | 10-0874155 | B1 | | 12/2008 | |
| KR | 10-0876201 | B1 | | 12/2008 | |
| KR | 10-2009-0006650 | A | | 1/2009 | |
| KR | 10-0876956 | B1 | | 1/2009 | |
| KR | 10-2009-0020962 | A | | 2/2009 | |
| KR | 10-0880912 | B1 | | 2/2009 | |
| KR | 10-0887922 | B1 | | 3/2009 | |
| KR | 10-0890202 | B1 | | 3/2009 | |
| KR | 10-2009-0039151 | A | | 4/2009 | |
| KR | 10-2009-0052674 | A | | 5/2009 | |
| KR | 10-2009-0055845 | A | | 6/2009 | |
| KR | 10-2009-0064979 | A | | 6/2009 | |

(56) References Cited

FOREIGN PATENT DOCUMENTS

| | | | |
|---|---|---|---|
| KR | 10-2009-0065961 | A | 6/2009 |
| KR | 10-2009-0066440 | A | 6/2009 |
| KR | 10-2009-0070262 | A | 7/2009 |
| KR | 10-2009-0077179 | A | 7/2009 |
| KR | 10-2009-0079040 | A | 7/2009 |
| KR | 10-2009-0080630 | A | 7/2009 |
| KR | 10-2009-0087260 | A | 8/2009 |
| KR | 10-2009-0093479 | A | 9/2009 |
| KR | 10-2009-0094662 | A | 9/2009 |
| KR | 10-2009-0099028 | A | 9/2009 |
| KR | 10-2009-0102932 | A | 10/2009 |
| KR | 10-2009-0105323 | A | 10/2009 |
| KR | 10-2009-0115258 | A | 11/2009 |
| KR | 10-2009-0119540 | A | 11/2009 |
| KR | 10-2009-0120793 | A | 11/2009 |
| KR | 10-0924958 | B1 | 11/2009 |
| KR | 10-2010-0004633 | A | 1/2010 |
| KR | 10-2010-0009199 | A | 1/2010 |
| KR | 10-2010-0026024 | A | 3/2010 |
| KR | 10-2010-0029790 | A | 3/2010 |
| KR | 10-0955792 | B1 | 5/2010 |
| KR | 10-2010-0059126 | A | 6/2010 |
| KR | 10-2010-0062708 | A | 6/2010 |
| KR | 10-2010-0065443 | A | 6/2010 |
| KR | 10-2010-0066246 | A | 6/2010 |
| KR | 10-0974085 | B1 | 8/2010 |
| KR | 10-2010-0096712 | A | 9/2010 |
| KR | 10-0983811 | B1 | 9/2010 |
| KR | 10-2010-0109291 | A | 10/2010 |
| KR | 10-2010-0117727 | A | 11/2010 |
| KR | 10-2010-0121253 | A | 11/2010 |
| KR | 10-2010-0134274 | A | 12/2010 |
| KR | 10-2010-0134276 | A | 12/2010 |
| KR | 10-2010-0137070 | A | 12/2010 |
| KR | 10-2010-0137075 | A | 12/2010 |
| KR | 10-2010-0137968 | A | 12/2010 |
| KR | 10-2010-0137969 | A | 12/2010 |
| KR | 10-2010-0137971 | A | 12/2010 |
| KR | 10-2011-0037533 | A | 4/2011 |
| KR | 10-2011-0057818 | A | 6/2011 |
| KR | 10-2011-0059656 | A | 6/2011 |
| KR | 10-2011-0075725 | A | 7/2011 |
| KR | 10-2011-0075788 | A | 7/2011 |
| KR | 10-2011-0076049 | A | 7/2011 |
| KR | 10-2011-0090012 | A | 8/2011 |
| KR | 10-2011-0092371 | A | 8/2011 |
| KR | 10-2011-0098590 | A | 9/2011 |
| KR | 10-2011-0098591 | A | 9/2011 |
| KR | 10-1064514 | B1 | 9/2011 |
| KR | 10-1108448 | B1 | 1/2012 |
| KR | 10-2012-0019623 | A | 3/2012 |
| KR | 10-1117523 | B1 | 3/2012 |
| KR | 10-2012-0035546 | A | 4/2012 |
| KR | 10-20120041230 | A | 4/2012 |
| KR | 10-20120054774 | A | 5/2012 |
| KR | 10-20120056376 | A | 6/2012 |
| KR | 10-20120076996 | A | 7/2012 |
| KR | 10-20120077003 | A | 7/2012 |
| KR | 10-20120118149 | A | 10/2012 |
| KR | 10-20120118877 | A | 10/2012 |
| KR | 10-20130003833 | A | 1/2013 |
| KR | 10-20130003946 | A | 1/2013 |
| KR | 10-1237841 | B1 | 2/2013 |
| KR | 10-20130044273 | A | 5/2013 |
| KR | 10-20130044993 | A | 5/2013 |
| KR | 10-20130046780 | A | 5/2013 |
| KR | 10-20130060958 | A | 6/2013 |
| KR | 10-20130096395 | A | 8/2013 |
| KR | 10-20130097256 | A | 9/2013 |
| KR | 10-20140002333 | A | 1/2014 |
| KR | 10-20140006419 | A | 1/2014 |
| KR | 10-20140026928 | A | 3/2014 |
| KR | 10-20140026929 | A | 3/2014 |
| KR | 10-20140037514 | A | 3/2014 |
| KR | 10-1380117 | B1 | 4/2014 |
| KR | 10-20140046428 | A | 4/2014 |
| KR | 10-20140060915 | A | 5/2014 |
| KR | 10-20140073235 | A | 6/2014 |
| KR | 10-1415268 | B1 | 7/2014 |
| KR | 10-20140083028 | A | 7/2014 |
| KR | 10-1426506 | B1 | 8/2014 |
| KR | 10-1434622 | B1 | 8/2014 |
| KR | 10-1437291 | B1 | 9/2014 |
| KR | 10-1467692 | B1 | 12/2014 |
| KR | 10-20140136826 | A | 12/2014 |
| KR | 10-2015-0011107 | A | 1/2015 |
| KR | 10-20150004021 | A | 1/2015 |
| KR | 10-20150030412 | A | 3/2015 |
| KR | 10-1511491 | B1 | 4/2015 |
| KR | 10-1522790 | B1 | 5/2015 |
| KR | 10-20150056164 | A | 5/2015 |
| KR | 10-2015-0093335 | A | 8/2015 |
| KR | 10-2015-0108046 | A | 9/2015 |
| KR | 10-2015-0124675 | A | 11/2015 |
| KR | 10-2015-0131949 | A | 11/2015 |
| KR | 10-1565997 | B1 | 11/2015 |
| KR | 10-1572054 | B1 | 12/2015 |
| KR | 10-2016-0000215 | A | 1/2016 |
| KR | 10-2016-0037018 | A | 4/2016 |
| KR | 10-1613094 | B1 | 5/2016 |
| KR | 10-2016-0080754 | A | 7/2016 |
| KR | 10-1640351 | B1 | 7/2016 |
| WO | 2016/180281 | A1 | 11/2016 |

* cited by examiner

AIR CONDITIONER

CROSS-REFERENCE TO RELATED APPLICATION

This application is related to and claims priority to Korean Patent Application No. 10-2017-0035151, filed on Mar. 21, 2017, the contents of which are incorporated herein by reference.

TECHNICAL FIELD

Embodiments of the present disclosure relate to an air conditioner, and more particularly, to an air conditioner having an improved flow path structure.

BACKGROUND

In general, an air conditioner is an apparatus to adjust temperature, humidity, air current, and distribution to optimal conditions at which humans are suitable to be active using a cooling cycle, while removing dust, etc. from the air. Main components constituting the cooling cycle include a compressor, a condenser, an evaporator, an expansion valve, and a blow fan.

The air conditioner can be classified into a split type air conditioner in which an indoor unit and an outdoor unit are separated and installed, and a window type air conditioner in which an indoor unit and an outdoor unit are installed together in a single cabinet.

The indoor unit of the split type air conditioner includes a heat exchanger to heat-exchange air inhaled to the inside of the panel, and a blow fan to inhale indoor air to the inside of the panel and to again discharge the inhaled air to an indoor space.

The split type air conditioner can be classified into a frame type, a wall-mounted type, a stand type, a ceiling duct type, and a duct type, etc. according to a location where the indoor unit is installed or according to the shape of the indoor unit.

The duct type air conditioner in which the indoor unit is inserted and installed in the ceiling or wall to discharge conditioned air to indoor space includes ducts to guide inhalation and exhalation of air.

SUMMARY

To address the above-discussed deficiencies, it is a primary object to provide an air conditioner with a uniform distribution of flow velocity.

It is another aspect of the present disclosure to provide an air conditioner with high heat-exchange efficiency.

It is another aspect of the present disclosure to provide an air conditioner capable of minimizing installation space.

It is another aspect of the present disclosure to provide an air conditioner on which a maintenance work can be performed from above or below with a relatively simple configuration.

Additional aspects of the disclosure will be set forth in part in the description which follows and, in part, will be obvious from the description, or may be learned by practice of the disclosure.

In accordance with one aspect of the present disclosure, an air conditioner include a housing including an inlet and an outlet, a discharge duct connected to the outlet, and configured to guide air discharged from the outlet to an indoor space, a blow fan assembly disposed in the inside of the housing such that a rotating shaft of the blow fan assembly extends in a vertical direction, and configured to inhale air in the vertical direction in which the rotating shaft extends, and discharge the air in a radial direction, and a heat exchanger extending along a part of a circumference of the blow fan assembly, and including a bending portion.

A plurality of blow fan assemblies may be provided, and each of the plurality of blow fan assemblies may include a blow fan rotating on the rotating shaft, and a driving part configured to rotate the blow fan.

The blow fan assembly may be disposed adjacent to the outlet, and the heat exchanger may be disposed adjacent to the inlet.

The heat exchanger may configure to cover at least one of left and right portions of the blow fan assembly and a rear portion of the blow fan assembly.

The blow fan assembly may include a blow fan rotating on the rotating shaft, a driving part configured to rotate the blow fan, and a fan case configured to cover the blow fan, and including a first boss detachably coupled with one inner side of the housing, and a second boss detachably coupled with the other inner side of the housing that is opposite to the one inner side of the housing.

The fan case may include a first fan case on which the first boss is formed, and a second fan case on which the second boss is formed.

The driving part may be fixed on the first fan case.

The housing may include a body frame coupled with the first boss or the second boss, and including an opening, and a first cover coupled with the second boss when the body frame is coupled with the first boss, and the first boss when the body frame is coupled with the second boss.

The first cover may cover a portion of the opening, and the housing further comprises a second cover fixed on the body frame to cover the other portion of the opening.

The body frame may include a plate portion configured to cover an upper or lower part of the blow fan assembly, and a bending portion bent from the plate portion and configured to cover left and right parts of the blow fan assembly.

The air conditioner may further include a drain pan disposed below the heat exchanger, and configured to collect condensate water.

The drain pan may include a curved portion formed to correspond to the bending portion of the heat exchanger.

The housing may include a front panel disposed in the outlet, and including a front opening corresponding to a fan case discharging opening formed in the fan case.

In accordance with another aspect of the present disclosure, an air conditioner include a housing including an inlet and an outlet, an discharge duct connected to the outlet, and configured to guide air discharged from the outlet to an indoor space, a blow fan disposed in the inside of the housing such that a rotating shaft of the blow fan extends in a vertical direction, a fan case configured to cover the blow fan, and including a first boss detachably coupled with one inner side of the housing, and a second boss detachably coupled with the other inner side of the housing that is opposite to the one inner side of the housing, and a heat exchanger disposed on a flow path of air between the inlet and the outlet.

The heat exchanger may be disposed on the flow of air between the inlet and the blow fan.

The heat exchanger may extend along a circumference of the blow fan to cover at least one portion of the circumference of the blow fan.

The housing may include a body frame configured to cover an upper or lower part of the fan case, and a first cover configured to cover the lower part of the fan case when the body frame covers the upper part of the fan case, and cover the upper part of the fan case when the body frame covers the lower part of the fan case.

The fan case may be fixed on the body frame, and the first cover nay be detachably coupled with the fan case.

The housing may be fixed on the body frame, and may include a second cover disposed in one side where the first cover is disposed.

In accordance with still another aspect of the present disclosure, an air conditioner include a housing including an inlet and an outlet, an discharger duct connected to the outlet, and configured to guide air discharged from the outlet to an indoor space, a blow fan disposed in the inside of the housing, and configured to inhale air in a vertical direction and to discharge the air toward the outlet, a heat exchanger disposed on a flow path of air between the blow fan and the inlet and including a bending portion to cover at least one portion of the blow fan, and a fan case on which the blow fan is rotatably installed, and including a first boss configured to be coupled with one inner side of the housing and the other inner side of the housing that is opposite to the one inner side of the housing, and a second boss configured to be coupled with the one inner side of the housing and the other inner side of the housing.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
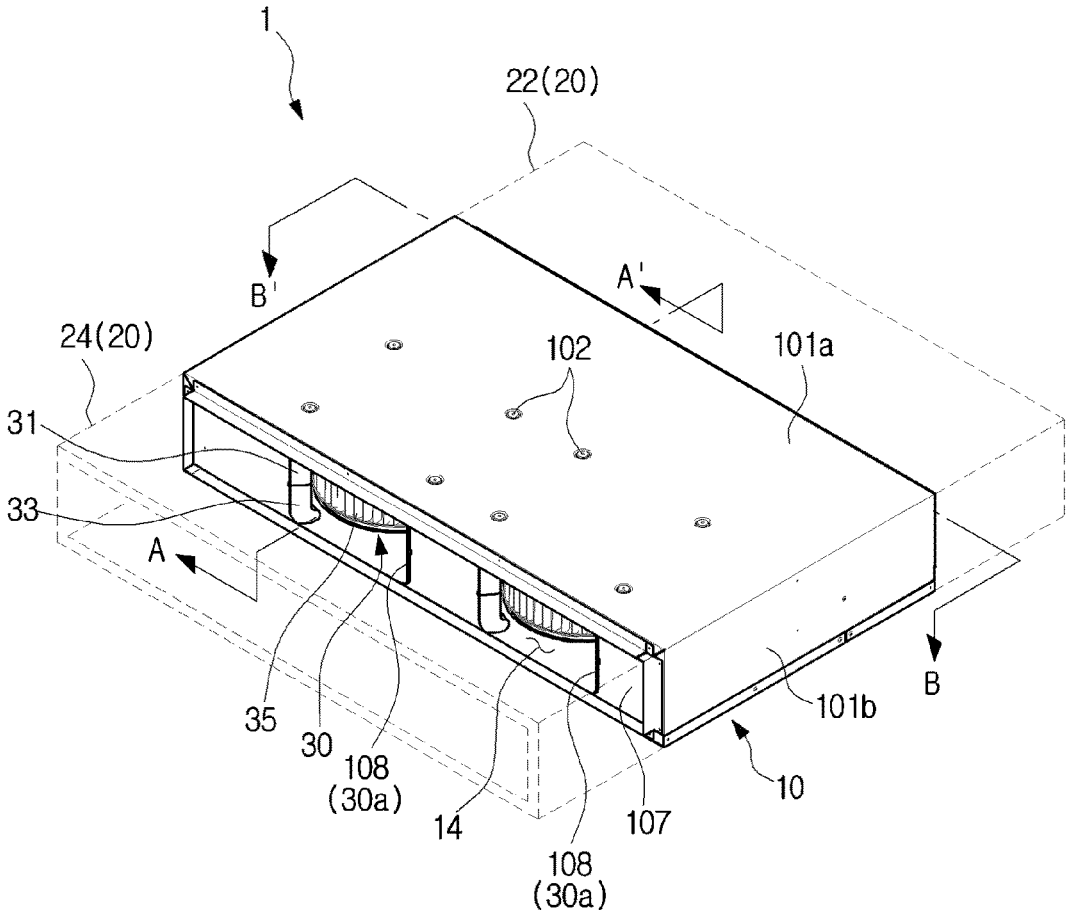
FIG. 1 is a perspective view of an air conditioner according to various embodiments of the present disclosure.

FIGS. 1 through 9, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

The terms used in the present specification are used to describe the embodiments of the present disclosure. Accordingly, it should be apparent to those skilled in the art that the following description of exemplary embodiments of the present application is provided for illustration purpose only and not for the purpose of limiting the application as defined by the appended claims and their equivalents. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

It will be understood that, although the terms first, second, etc. may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

Meanwhile, the terms "front direction", "rear direction", "upper part", "lower part", "left", and "right", when used in this specification, are defined based on the drawings, and the shapes and locations of the corresponding components are not limited by the terms.

A cooling cycle constituting an air conditioner may be configured with a compressor, a condenser, an expansion valve, and an evaporator. The cooling cycle may perform a series of processes of compression-condensation-expansionevaporation so as to heat-exchange air with refrigerants and then supply the resultant conditioned air.

The compressor may compress refrigerant gas to a high-temperature, high-pressure state, and discharge the compressed refrigerant gas to the condenser. The condenser may condense the compressed refrigerant gas to a liquid state, and emit heat to the surroundings during the condensing process.

The expansion valve may expand the liquid-state refrigerants in the high-temperature, high-pressure state condensed by the condenser to liquid-state refrigerants in a low-pressure state. The evaporator may evaporate the refrigerants expanded by the expansion valve. The evaporator may achieve a cooling effect through heat-exchange with an object to be cooled using evaporative latent heat of refrigerants, and return the refrigerant gas in the low-temperature, low-pressure state to the compressor. Through the cycle, the air conditioner can adjust the temperature of the indoor space.

An outdoor unit of the air conditioner may be a part of the cooling cycle, configured with a compressor and an outdoor heat exchanger. An indoor unit of the air conditioner may include an indoor heat exchanger, and the expansion valve may be installed in any one of the indoor unit and the outdoor unit. The indoor heat exchanger and the outdoor heat exchanger may function as a condenser or an evaporator. When the indoor heat exchanger is used as a condenser, the air conditioner may function as a heater, and when the indoor heat exchanger is used as an evaporator, the air conditioner may function as a cooler.

Hereinafter, the embodiments of the present disclosure will be described in detail with reference to the accompanying drawings.

Figure 2:
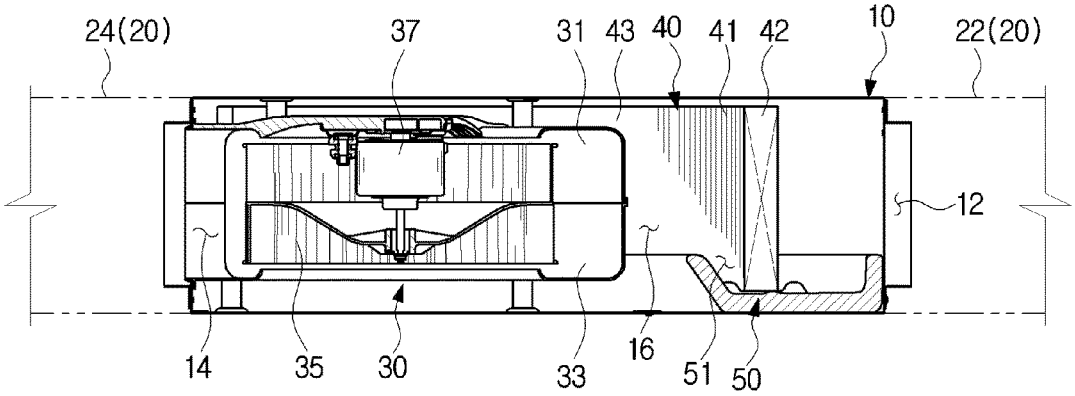
FIG. 2 is a cross-sectional view of the air conditioner, taken along a line A-A' of FIG. 1 according to various embodiments of the present disclosure.
Figure 3:
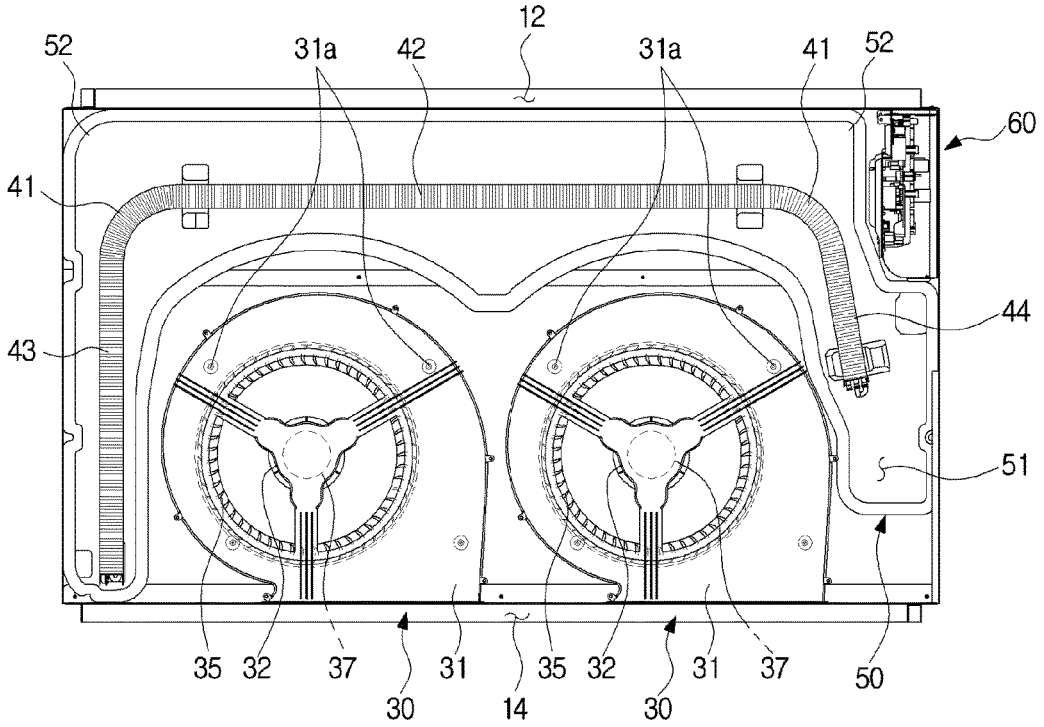
FIG. 3 is a cross-sectional view of the air conditioner, taken along a line B-B' of FIG. 1 according to various embodiments of the present disclosure.

FIG. 1 is a perspective view of an air conditioner according to an embodiment of the present disclosure, and FIG. 2 is a cross-sectional view of the air conditioner, taken along a line A-A' of FIG. 1. FIG. 3 is a cross-sectional view of the air conditioner, taken along a line B-B' of FIG. 1.

As shown in FIGS. 1 to 3, an air conditioner 1 may include a housing 10 including an inlet 12 that air enters and an outlet 14 from which air is discharged, a pair of ducts 20 coupled with the inlet 12 and the outlet 14, respectively, a blow fan assembly 30 installed in the inside of the housing 10 and configured to inhale or discharge air, and a heat exchanger 40 configured to heat-exchange with the inhaled air.

The housing 10 may form an outer appearance of the air conditioner 1, wherein components, such as the blow fan assembly 30, the heat exchanger 40, etc., may be installed in the inside of the housing 10. The inlet 12 may be formed in one side of the housing 10, and the outlet 14 may be formed at the other side of the housing 10 that is opposite to the one side of the housing 10. The housing 10 may be attached and fixed on a wall, or may be fixed on a wall through wires, etc. so as to be spaced from the wall. The housing 10 may be embedded in a ceiling.

The housing 10 may include a flow path 16 connecting the inlet 12 to the outlet 14. The components, such as the blow fan assembly 30, the heat exchanger 40, etc., may be disposed on the flow path 16.

The housing 10 will be described in more detail, later.

The ducts 20 may cause the inside of the housing 10 to communicate with indoor space to guide air. More specifically, the ducts 20 may include an inlet duct 22 coupled with the inlet 12 of the housing 10 to guide air entered from the indoor space to the inside of the housing 10, and an discharge duct 24 coupled with the outlet 14 to guide air heat-exchanged in the inside of the housing 10 to the indoor space.

The blow fan assembly 30 may be disposed adjacent to the outlet 14 in the inside of the housing 10. The blow fan assembly 30 may inhale indoor air to the inside of the housing 10, heat-exchange the inhaled air, and then discharge the heat-exchanged air to the indoor space through the outlet 14.

The blow fan assembly 30 may be disposed such that a rotating shaft of the blow fan assembly 30 extends in a vertical direction. Accordingly, the radial direction of the blow fan assembly 30 may be a horizontal direction. The blow fan assembly 30 may inhale air in the vertical direction in which the rotating shaft extends, and discharge the air in the radial direction. The blow fan assembly 30 may inhale air in the substantially vertical direction, and discharge the air in the substantially horizontal direction.

The rotating shaft of a typical blow fan assembly extends in substantially left and right directions, and accordingly, a typical air conditioner needs to secure installation space such that the height of the installation space is higher than the size of the diameter of the typical blow fan assembly. If it is not easy to secure installation space, it is necessary to reduce the diameter of the blow fan assembly, resulting in a reduction in efficiency of the blow fan assembly.

In contrast, since the rotating shaft of the blow fan assembly 30 according to an embodiment extends in the substantially vertical direction, it is possible to significantly reduce the height of installation space of the air conditioner 1. That is, the blow fan assembly 30 according to an embodiment can reduce the height of the air conditioner 1, and accordingly, a user can easily secure installation space of the air conditioner 1. Also, since the air conditioner 1 can increase the diameter of the blow fan assembly 30 than in typical techniques, it is possible to increase the efficiency of the blow fan assembly 30.

A plurality of blow fan assemblies 30 may be provided. For example, a pair of blow fan assemblies 30 may be provided side by side. If a plurality of blow fan assemblies 30 are provided, each blow fan assembly 30 may include a blow fan 35 rotating on the rotating shaft, and a driving part 37 to rotate the blow fan 35. The plurality of blow fan assemblies 30 may be driven independently. By selectively driving the plurality of blow fan assemblies 30, the air conditioner 1 can adjust air volume.

Details about the blow fan assembly 30 will be described later.

The heat exchanger 40 may be disposed on the flow path 16 of air between the inlet 12 and the outlet 14. The heat exchanger 40 may be disposed adjacent to the inlet 12 in the inside of the housing 10. More specifically, the heat exchanger 40 may be disposed on the flow path 16 between the blow fan assemblies 30 and the inlet 12. The heat exchanger 40 may heat-exchange air entered the inside of the housing 10 through the inlet 12 to heat or cool the air.

The heat exchanger 40 may extend along circumferences of the blow fan assemblies 30, and have a bending portion 41. The heat exchanger 40 may cover at one part of the circumferences of the blow fan assemblies 30. The heat exchanger 40 may include a first portion 42 to cover rear parts of the blow fan assemblies 30. The bending portion 41 may be bent along the circumferences of the blow fan assemblies 30 from the rear parts of the blow fan assemblies 30, in order to cover left and/or right parts of the blow fan assemblies 30. The heat exchanger 40 may include a second portion 43 to cover the left part of the blow fan assemblies 30, and a third portion 44 to cover the right part of the blow fan assemblies 30.

Since the heat exchanger 40 extends along the circumferences of the blow fan assemblies 30 to surround the blow fan assemblies 30, the air conditioner 1 according to an embodiment of the present disclosure can increase an electric heating area, and accordingly, can raise heat-exchange efficiency.

In the current embodiment, the blow fan assemblies 30 are disposed adjacent to the outlet 14, and the heat exchanger 40 is disposed adjacent to the inlet 12. However, the locations of the blow fan assemblies 30 and the heat exchanger 40 are not limited to these. For example, the blow fan assemblies 30 may be disposed adjacent to the inlet 12, and the heat exchanger 40 may be disposed adjacent to the outlet 14.

The air conditioner 1 may include a drain pan 50 to collect condensate water generated from the heat exchanger 40. The drain pan 50 may be disposed below the heat exchanger 40. The heat exchanger 40 may be rested on the drain pan 50. The drain pan 50 may include water-collecting space 51 formed concavely. Condensate water may be collected in the water-collecting space 51.

The drain pan 50 may include a curved portion 52 formed to correspond to the bending portion 41 of the heat exchanger 40. Since the drain pan 50 is formed to correspond to the heat exchanger 40, the drain pan 50 can collect all of condensate water generated from the heat exchanger 40.

The air conditioner 1 may include a control box 60 to control the air conditioner 1. The control box 60 may be disposed in space separated from the water-collecting space 51 of the drain pan 50 so as to be prevented from being damaged due to condensate water collected in the drain pan 50. The control box 60 may be disposed adjacent to the left or right of the housing 10 in order not to interfere the flow of air.

Figure 4:
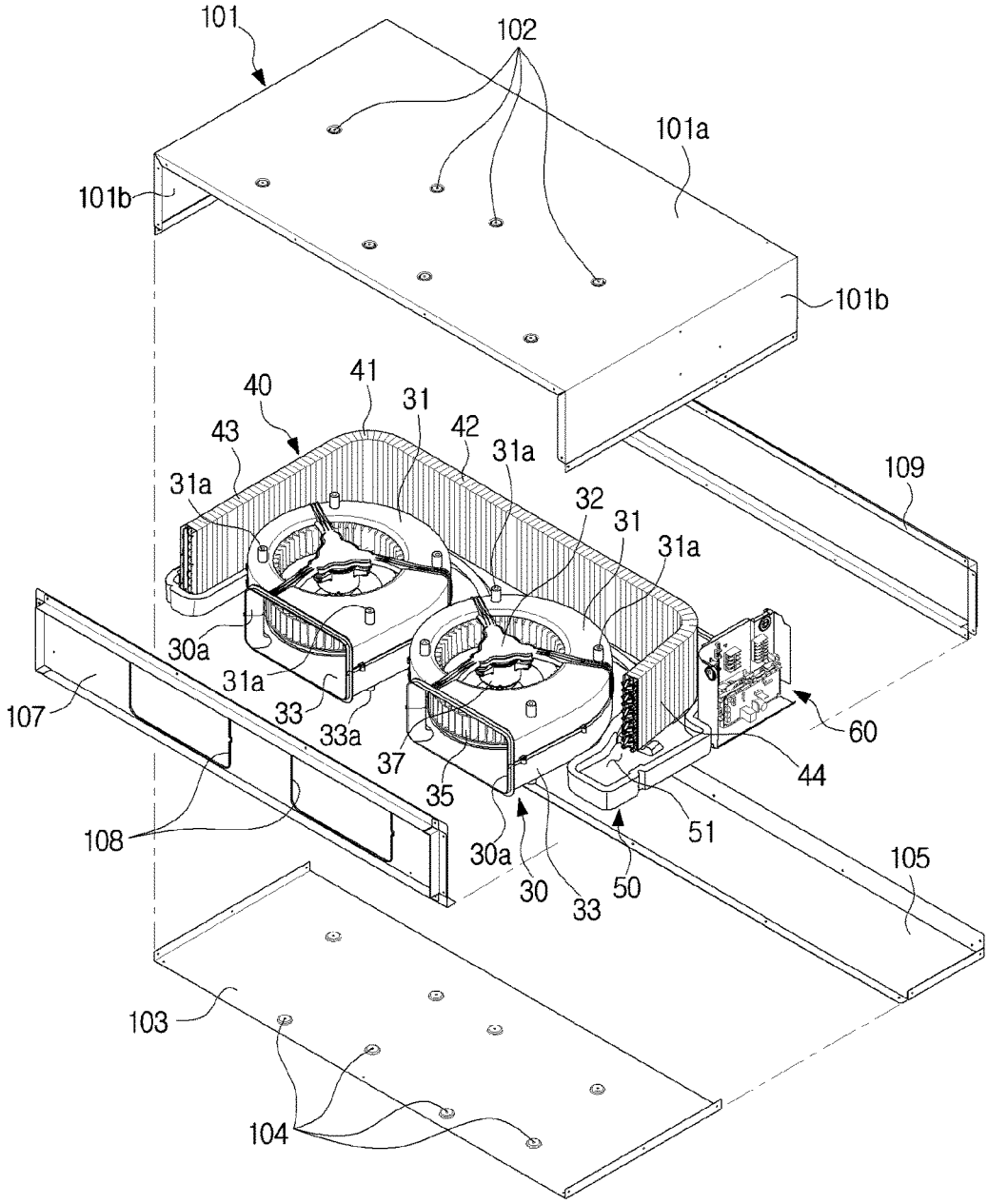
FIG. 4 is a view for describing a process of assembling the air conditioner shown in FIG. 1 such that the air conditioner can be serviced from below according to various embodiments of the present disclosure.
Figure 5:
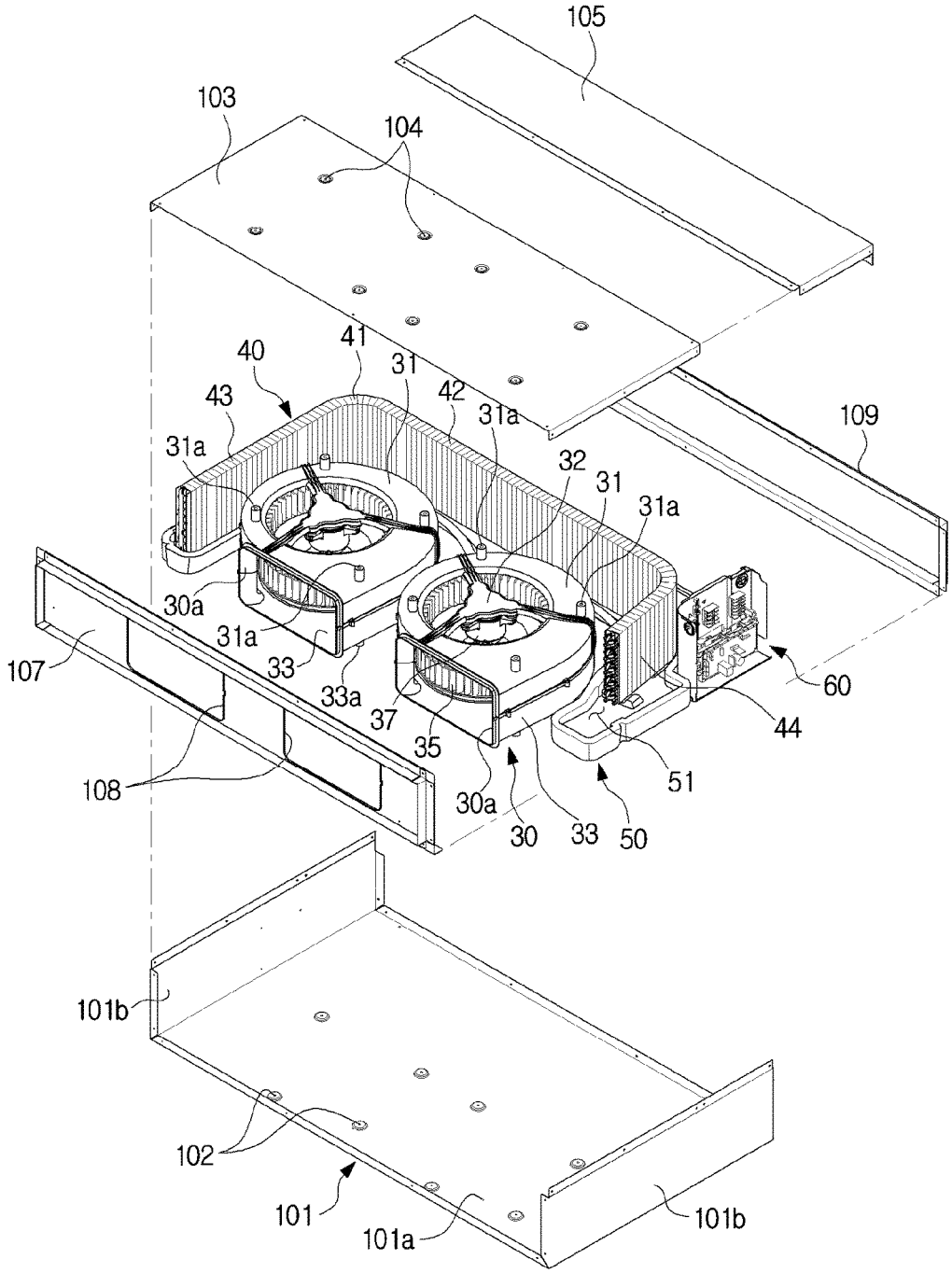
FIG. 5 is a view for describing a process of assembling the air conditioner shown in FIG. 1 such that the air conditioner can be serviced from above according to various embodiments of the present disclosure.
Figure 6:
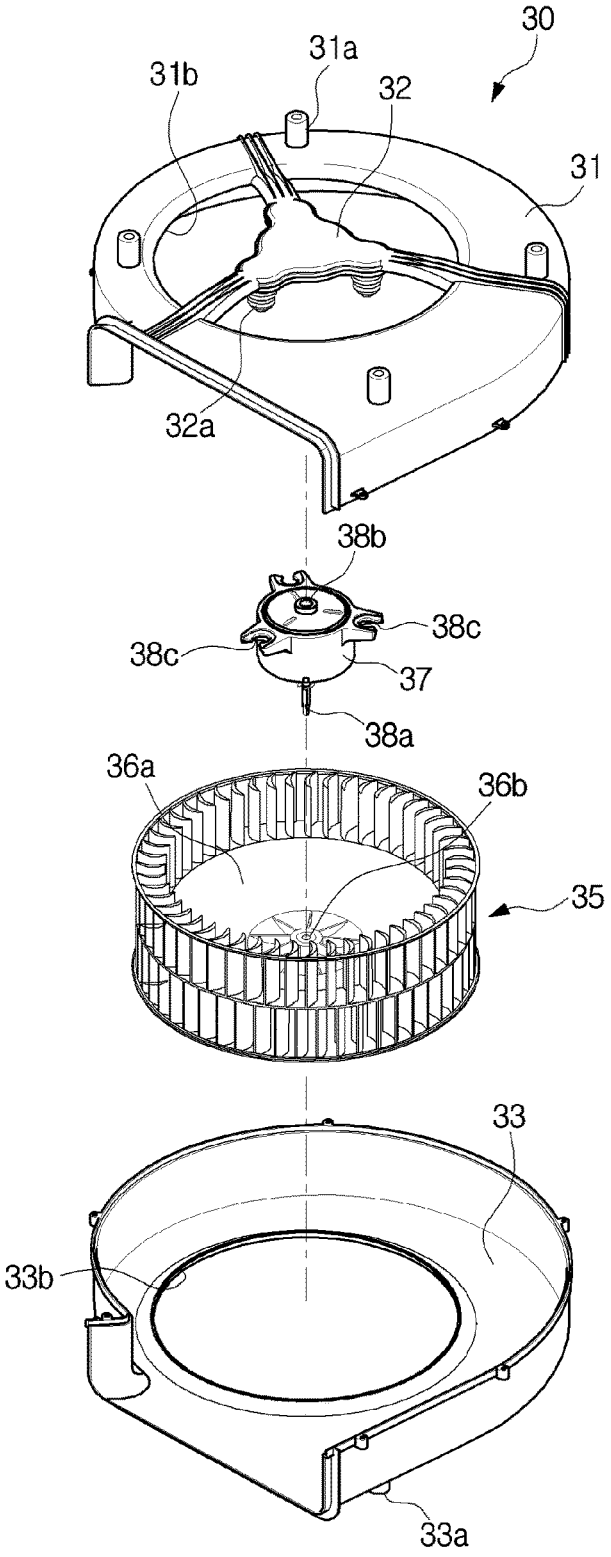
FIG. 6 is an exploded view of the blow fan assembly of FIGS. 4 and 5, shown from above according to various embodiment of the present disclosure.
Figure 7:
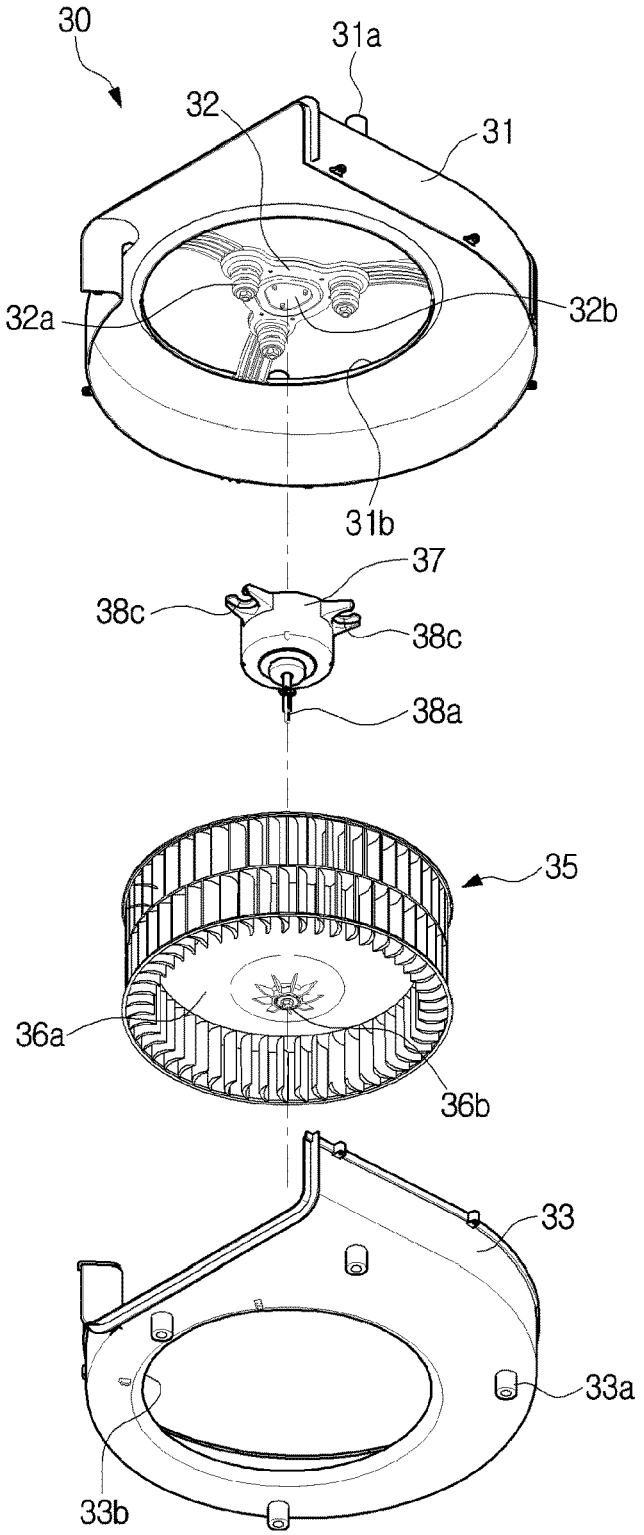
FIG. 7 is an exploded view of the blow fan assembly of FIGS. 4 and 5, shown from below according to various embodiments of the present disclosure.

FIG. 4 is a view for describing a process of assembling the air conditioner shown in FIG. 1 such that the air conditioner can be serviced from below. FIG. 5 is a view for describing a process of assembling the air conditioner shown in FIG. 1 such that the air conditioner can be serviced from above. FIG. 6 is an exploded view of the blow fan assembly of FIGS. 4 and 5, shown from above. FIG. 7 is an exploded view of the blow fan assembly of FIGS. 4 and 5, shown from below.

Hereinafter, the air conditioner 1 according to an embodiment of the present disclosure will be described in detail with reference to FIGS. 4 to 7.

Since a typical duct-type air conditioner could be subject to maintenance only through above or below, there was inconvenient to perform maintenance on the typical air conditioner. Also, the typical duct-type air conditioner includes a cover capable of being separated in both directions such that the air conditioner can be subject to maintenance from above or below according to a place where it is installed. However, the cover makes the structure of the air conditioner complicated and increases manufacturing cost.

Furthermore, the typical duct-type air conditioner that can be subject to maintenance only from above or below could not be installed in the opposite direction due to a structure for collecting condensate water generated from a heat exchanger. Accordingly, a typical air conditioner that can be subject to maintenance only from above could be installed only in a place where a user can access the top of the air conditioner, and a typical air conditioner that can be subject to maintenance only from below could be installed only in a place where a user can access the bottom of the air conditioner.

However, the housing 10 according to an embodiment of the present disclosure may include a body frame 101 and a first cover 103 that can be coupled selectively with the upper or lower part of the blow fan assembly 30 according to a place where the air conditioner 1 is installed.

The body frame 101 may include a plate portion 101*a* to cover the upper or lower part of the blow fan assembly 30, and a bending portion 101*b* to cover the left and right parts of the blow fan assembly 30. The bending portion 101*b* may be bent from the plate portion 101*a*, and extend in the vertical direction. When the air conditioner 1 is installed, the body frame 101 may be fixed on a wall or at a structure such as wires.

The body frame 101 may include a first coupling hole 102 to be coupled with a first boss 31*a* or a second boss 33*a* of the blow fan assembly 30, which will be described later. A plurality of first coupling holes 102 may be formed. The first coupling holes 102 may be formed with a size and shape corresponding to the first boss 31*a* and the second boss 33*a*, and the number of the first coupling holes 102 may be the same as that of the first boss 31*a* and the second boss 33*a*.

The first cover 103 may cover the upper or lower part of the blow fan assembly 30. When the air conditioner 1 is subject to maintenance, the first cover 103 may be separated from the body frame 101.

The first cover 103 may include a second coupling hole 104 to be coupled with the first boss 31*a* or the second boss 33*a* of the blow fan assembly 30. A plurality of second coupling holes 104 may be provided. The second coupling holes 104 may be formed with a size and shape corresponding to the first boss 31*a* and the second boss 33*a*, and the number of the second coupling holes 104 may be the same as that of the first boss 31*a* and the second boss 33*a*.

That is, the first coupling holes 102 of the body frame 101 may be coupled with any ones of the first boss 31*a* and the second boss 33*a*. Likewise, the second coupling holes 104 of the first cover 103 may be coupled with any ones of the first boss 31*a* and the second boss 33*a*. The first coupling holes 102 and the second coupling holes 104 may be formed in the same size and shape, and the number of the first coupling holes 102 may also be the same as that of the second coupling holes 104. According to the configuration, the air conditioner 1 can change an installation method in consideration of a place where it is installed.

The first cover 103 of the air conditioner 1 according to an embodiment of the present disclosure may be coupled with the lower part of the blow fan assembly 30, when the body frame 101 is coupled with the upper part of the blow fan assembly 30. Meanwhile, the first cover 103 of the air conditioner 1 may be coupled with the upper part of the blow fan assembly 30 when the body frame 101 is coupled with the lower part of the blow fan assembly 30.

More specifically, as shown in FIG. 4, when the air conditioner 1 is installed in a place where a user can access the air conditioner 1 from below, the body frame 101 may be coupled with the upper part of the blow fan assembly 30, and the first cover 103 may be coupled with the lower part of the blow fan assembly 30. More specifically, the first coupling hole 102 of the body frame 101 may be coupled with the first boss 31*a* formed on a first fan case 31 of the blow fan assembly 30, and the second coupling hole 104 of the first cover 103 may be coupled with the second boss 33*a* formed on a second fan case 33 of the blow fan assembly 30.

Meanwhile, when the air conditioner 1 is installed in a place where a user can access the air conditioner 1 from above, as shown in FIG. 5, the body frame 101 may be coupled with the lower part of the blow fan assembly 30, and the first cover 103 may be coupled with the upper part of the blow fan assembly 30. More specifically, the first coupling hole 102 of the body frame 101 may be coupled with the second boss 33*a* formed on the second fan case 33 of the blow fan assembly 30, and the second coupling hole 104 of the first cover 103 may be coupled with the first boss 31*a* formed on the first fan case 31 of the blow fan assembly 30.

At this time, the locations of the blow fan assembly 30, the heat exchanger 40, the drain pan 50, and the control box 60 may be fixed without changing.

The housing 10 may include a second cover 105. The second cover 105 may cover a part of one side of the air conditioner 1, the side covered by the first cover 103. The second cover 105 may be fixed on the body frame 101. The second cover 105 may form an opening 18 of the housing 10, together with the body frame 101 and a front panel 107. The second cover 105 may be fixed on the body frame 101 even when the first cover 103 is separated from the air conditioner 1 in order to perform maintenance on the air conditioner 1. The second cover 105 may support the drain pan 50 and/or the control box 60.

The housing 10 may include the front panel 107 disposed in the outlet 14. The front panel 107 may include a front opening 108 corresponding to a fan case discharging opening 30*a* of the blow fan assembly 30. The front panel 107 may prevent the inside space of the housing 10 from being exposed to the outside. The front panel 107 may be connected to the discharge duct 24. That is, the discharge duct 24 may be fixed on the front panel 107.

The housing 10 may include a rear frame 109. The rear frame 109 may be connected to the inlet duct 22. That is, the inlet duct 22 may be fixed on the rear frame 109.

The blow fan assembly 30 may include the fan cases 31 and 33, the blow fan 35 rotatably installed in the inside of the fan cases 31 and 33, and the driving part 37 to rotate the blow fan 35.

The fan cases 31 and 33 may include a fan case opening 30*a* to guide discharged air in the radial direction. The fan cases 31 and 33 may include the first boss 31*a* detachably coupled with one inner side of the housing 10, and the second boss 33*a* detachably coupled with the other inner side of the housing 10 that is opposite to the one inner side of the housing 10.

More specifically, the fan cases 31 and 33 may include the first fan case 31 and the second fan case 33. The first fan case 31 may cover the upper part of the blow fan 35, and the second fan case 33 may cover the lower part of the blow fan 35.

The first fan case 31 may include the first boss 31*a* protruding from the upper surface. The first boss 31*a* may be coupled with the first coupling hole 102 of the body frame 101 or the second coupling hole 104 of the first cover 103. The first fan case 31 may include an opening 31*b* that air enters.

The first fan case 31 may include a driving part fixing portion 32 to fix the driving part 37 thereon. The driving part fixing portion 32 may be disposed at the substantially center of the opening 31*b* of the first fan case 31. The driving part fixing portion 32 may include a case fixing portion 32*a* to be coupled with a driving part coupling portion 38*c* of the driving part 37.

The second fan case 33 may include the second boss 33*a* protruding from the lower surface. The second boss 33*a* may be coupled with the first coupling hole 102 of the body frame 101 or the second coupling hole 104 of the first cover 103. The second fan case 33 may include an opening 33*b* that air enters.

The first boss 31*a* and the second boss 33*a* may be formed in the same size and shape, and the number of the first boss 31*a* may also be the same as that of the second boss 33*a*.

The blow fan 35 may rotate on the rotating shaft extending in the substantially vertical direction. The blow fan 35 may include a plate 36*a* extending in the radial direction from the substantially center of the rotating shaft in the extending direction of the rotating shaft. A driving part coupling groove 36*b* may be formed in the plate 36*a*. The driving part coupling groove 36*b* may be connected to the driving part 37 to receive power from the driving part 37. According to the configuration, air entered through the opening 31*b* of the first fan case 31 may be discharged in the radial direction via the upper area of the blow fan 35, and air entered through the opening 33*b* of the second fan case 33 may be discharged in the radial direction via the lower area of the blow fan 35. That is, the blow fan 35 may discharge air in the front direction.

The driving part 37 may be fixed on the first fan case 31. The driving part 37 may include a driving source (not shown) to generate power for rotating the blow fan 35.

The driving part 37 may include a power transfer member 38*a* connected to the blow fan 35 to transfer power to the blow fan 35. The power transfer member 38*a* may be inserted into and fixed on the driving part coupling groove 36*b* of the blow fan 35 to rotate the blow fan 35.

The driving part 37 may include a case coupling portion 38*b* fixed on the driving part fixing portion 32 of the first fan case 31. The case coupling portion 38*b* may be formed on the upper surface of the driving part 37. The driving part 37 may include the driving part coupling portion 38*c* to be coupled with the case fixing portion 32*a*. The driving part coupling portion 38*c* may be screw-coupled with the case fixing portion 32*a*. The driving part 37 may be fixed on the first fan case 31 by the case coupling portion 38*b* and the driving part coupling portion 38*c*.

Figure 8:
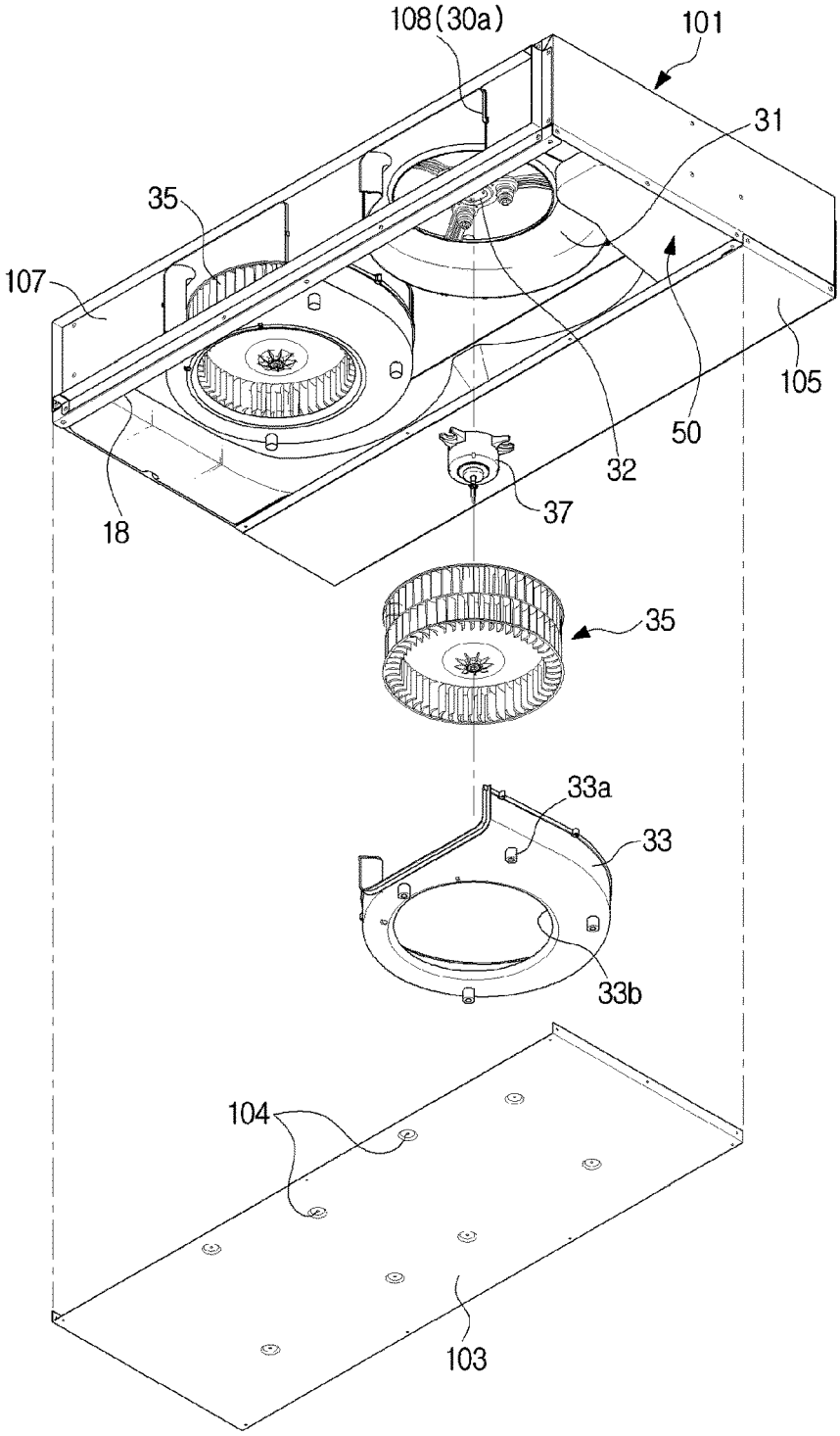
FIG. 8 shows the air conditioner shown in FIG. 4 when the air conditioner is serviced from below according to various embodiments of the present disclosure.
Figure 9:
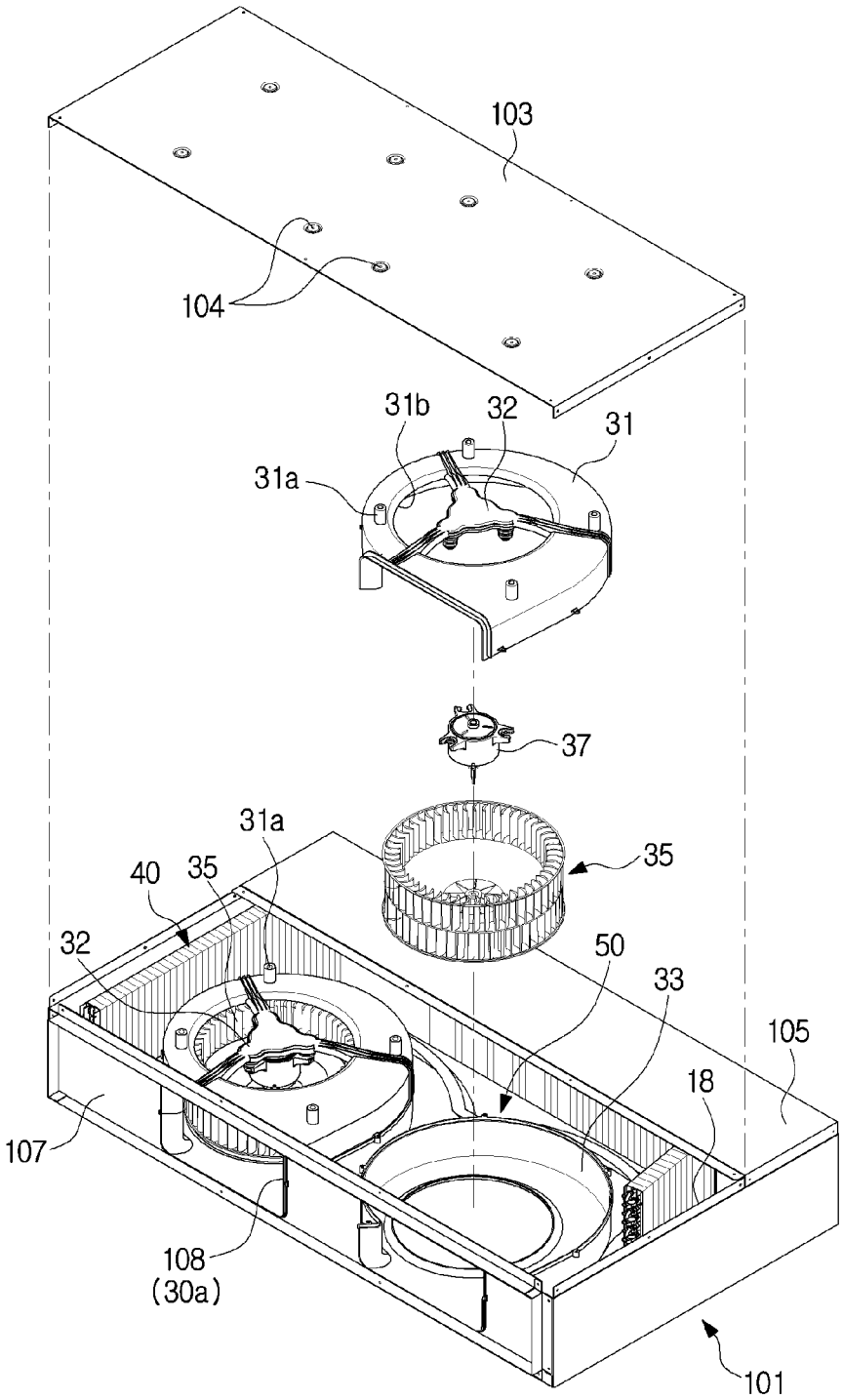
FIG. 9 shows the air conditioner shown in FIG. 5 when the air conditioner is serviced from above according to various embodiments of the present disclosure.

FIG. 8 shows the air conditioner shown in FIG. 4 when the air conditioner is serviced from below. FIG. 9 shows the air conditioner shown in FIG. 5 when the air conditioner is serviced from above.

Referring to FIG. 8, when the air conditioner 1 is installed in a place where a user can easily access the air conditioner 1 from below, the body frame 101 may be coupled with the upper part of the blow fan assembly 30, and the first cover 103 and the second cover 105 may be coupled with the lower part of the blow fan assembly 30.

When the air conditioner 1 shown in FIG. 8 is subject to maintenance, the first cover 103 may be separated from the blow fan assembly 30 and the body frame 101. That is, the first cover 103 coupled with the second boss 33*a* may be separated from the second fan case 33.

Accordingly, a part of the opening 18 of the body frame 101 of the housing 10, covered by the first cover 103, may open. The other part of the opening 18 may be covered by the second cover 105.

Successively, the second fan case 33 may be separated from the first fan case 31. Then, the blow fan 35 may be separated from the driving part 37. Successively, the driving part 37 may be separated from the first fan case 31. At this time, the first fan case 31 may be fixed on the body frame 101, and the body frame 101 may be fixed on a wall on which the air conditioner 1 is installed or at a structure such as wires.

After the air conditioner 1 is sequentially dissembled in this order, the air conditioner 1 may be subject to maintenance, and then can be assembled in reverse order.

Meanwhile, as shown in FIG. 9, when the air conditioner 1 is installed in a place where a user can easily access the air conditioner 1 from above, the body frame 101 may be coupled with the lower part of the blow fan assembly 30, and the first cover 103 and the second cover 105 may be coupled with the upper part of the blow fan assembly 30.

When the air conditioner 1 shown in FIG. 9 is subject to maintenance, the first cover 103 may be separated from the blow fan assembly 30 and the body frame 101. That is, the first cover 103 coupled with the first boss 31*a* may be separated from the first fan case 31. Accordingly, a part of the opening 18 of the body frame 101 of the housing 10, covered by the first cover 103, may open. At this time, the other part of the opening 18 may be covered by the second cover 105.

Successively, the first fan case 31 may be separated from the second fan case 33. Since the driving part 37 is fixed on the first fan case 31, the driving part 37 may be separated from the second fan case 33, together with the first fan case 31. Also, since the blow fan 35 is fixed on the driving part 37, the blow fan 35 may be separated from the second fan case 33, together with the first fan case 31.

After the air conditioner 1 is sequentially dissembled in this order, the air conditioner 1 may be subject to maintenance, and then can be assembled in reverse order.

According to the configuration, the air conditioner 1 according to an embodiment of the present disclosure can be easily subject to maintenance by changing a method of assembling the housing 10 regardless of a place where the air conditioner 1 is installed. Also, since the air conditioner 1 can be easily subject to maintenance through a simple configuration regardless of a place where the air conditioner 1 is installed, manufacturing cost can be reduced.

According to the technical concepts of the present disclosure, the air conditioner can achieve a uniform distribution of flow velocity by disposing the rotating shaft of the blow fan in the vertical direction.

According to the technical concepts of the present disclosure, the air conditioner can raise heat-exchange efficiency by providing the heat exchanger having the bending portion to cover the circumference of the blow fan.

According to the technical concepts of the present disclosure, the air conditioner can reduce the height by disposing the rotating shaft of the blow fan in the vertical direction, resulting in a reduction in height of installation space.

According to the technical concepts of the present disclosure, the air conditioner can increase the diameter of the blow fan by disposing the rotating shaft of the blow fan in the vertical direction, resulting in an increase in efficiency of the blow fan.

According to the technical concepts of the present disclosure, the air conditioner can be subject to maintenance selectively from above or from below by changing a method of installing the housing without adding another component, since the first cover, the second cover, and the body frame of the housing can be installed selectively on the upper or lower part of the blow fan.

Although a few embodiments of the present disclosure have been shown and described, it would be appreciated by those skilled in the art that changes may be made in these embodiments without departing from the principles and spirit of the disclosure, the scope of which is defined in the claims and their equivalents.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. An air conditioner comprising:

a housing including an inlet and an outlet and further comprising:

a body frame being interchangeable such that the body frame configured to cover an upper part of a fan case or a lower part of the fan case; and a first cover being interchangeable such that the first cover configured to:

cover the lower part of the fan case when the body frame covers the upper part of the fan case, and cover the upper part of the fan case when the body frame covers the lower part of the fan case;

a discharge duct connected to the outlet, and configured to guide air discharged from the outlet to an indoor space;

a blow fan assembly, of one or more blow fan assemblies, disposed in the inside of the housing such that a rotating shaft of the blow fan assembly extends in a vertical direction with respect to a top or a bottom surface of the housing, and configured to:

inhale air in the vertical direction in which the rotating shaft extends, and discharge the air in a radial direction;

wherein the blow fan assembly comprises:

the fan case configured to cover the blow fan assembly, and including:

a first boss detachable coupled with one inner side of the housing, wherein the first boss protrudes from an upper surface of the fan case, and a second boss detachably coupled with an other inner side of the housing that is opposite to the one inner side of the housing wherein the second boss protrudes from a lower surface of the fan case; and a heat exchanger extending along a part of a circumference of the blow fan assembly, and including a bending portion.

2. The air conditioner according to claim 1, wherein the blow fan assembly comprises:

a blow fan rotating on the rotating shaft, and a driving motor configured to rotate the blow fan.

3. The air conditioner according to claim 1, wherein:

the blow fan assembly is disposed adjacent to the outlet, and the heat exchanger is disposed adjacent to the inlet.

4. The air conditioner according to claim 1, wherein the heat exchanger configured to cover at least one of left and right portions of the blow fan assembly and a rear portion of the blow fan assembly.

5. The air conditioner according to claim 1, wherein the blow fan assembly comprises:

a blow fan rotating on the rotating shaft; and a driving motor configured to rotate the blow fan.

6. The air conditioner according to claim 5, wherein the fan case comprises:

a first fan case on which the first boss is formed, and a second fan case on which the second boss is formed.

7. The air conditioner according to claim 6, wherein the driving motor is fixed on the first fan case.

8. The air conditioner according to claim 5, wherein:

the first cover covers a portion of the opening, and the housing further comprises a second cover fixed on the body frame to cover an other portion of the opening.

9. The air conditioner according to claim 5, wherein the body frame comprises:

a plate portion configured to cover an upper part of the blow fan assembly or a lower part of the blow fan assembly, and a bending portion bent from the plate portion and configured to cover left and right parts of the blow fan assembly.

10. The air conditioner according to claim 1, further comprising a drain pan disposed below the heat exchanger, and configured to collect condensate water.

11. The air conditioner according to claim 10, wherein the drain pan comprises a curved portion formed to correspond to the bending portion of the heat exchanger.

12. The air conditioner according to claim 1, wherein the housing comprises a front panel disposed in the outlet, and including a front opening corresponding to a fan case discharging opening formed in the fan case.

13. An air conditioner comprising:

a housing including an inlet and an outlet and further comprising:

a body frame being interchangeable such that the body frame configured to cover an upper part of a fan case or lower part of the fan case; and a first cover being interchangeable such that the first cover configured to:

cover the lower part of the fan case when the body frame covers the upper part of the fan case, and cover the upper part of the fan case when the body frame covers the lower part of the fan case;

a discharge duct connected to the outlet, and configured to guide air discharged from the outlet to an indoor space;

a blow fan disposed in the inside of the housing such that a rotating shaft of the blow fan extends in a vertical direction with respect to a top or a bottom surface of the housing;

the fan case configured to cover the blow fan, and including:

a first boss detachably coupled with one inner side of the housing, wherein the first boss protrudes from an upper surface of the fan case, and a second boss detachably coupled with an other inner side of the housing that is opposite to the one inner side of the housing, wherein the second boss protrudes from a lower surface of the fan case; and a heat exchanger disposed on a flow path of air between the inlet and the outlet.

14. The air conditioner according to claim 13, wherein the heat exchanger is disposed on the flow path of air between the inlet and the blow fan.

15. The air conditioner according to claim 13, wherein the heat exchanger extends along a circumference of the blow fan to cover at least one portion of the circumference of the blow fan.

16. The air conditioner according to claim 13, wherein:

the fan case is fixed on the body frame, and the first cover is detachably coupled with the fan case.

17. The air conditioner according to claim 13, wherein the housing is fixed on the body frame, and comprises a second cover disposed in one side where the first cover is disposed.

18. An air conditioner comprising:

a housing including an inlet and an outlet and further comprising:

a body frame being interchangeable such that the body frame configured to cover an upper part of a fan case or lower part of the fan case; and a first cover being interchangeable such that the first cover configured to:

cover the lower part of the fan case when the body frame covers the upper part of the fan case, and cover the upper part of the fan case when the body frame covers the lower part of the fan case;

a discharger duct connected to the outlet, and configured to guide air discharged from the outlet to an indoor space;

a blow fan disposed in the inside of the housing such that a rotating shaft of the blow fan extends in a vertical direction with respect to a top or a bottom surface of the housing, and configured to inhale air in the vertical direction and to discharge the air toward the outlet;

a heat exchanger disposed on a flow path of air between the blow fan and the inlet, and including a bending portion to cover at least one portion of the blow fan; and the fan case on which the blow fan is rotatably installed, and including:

a first boss configured to be coupled with one inner side of the housing and an other inner side of the housing that is opposite to the one inner side of the housing, wherein the first boss protrudes from an upper surface of the fan case, and a second boss configured to be coupled with the one inner side of the housing and the other inner side of the housing, wherein the second boss protrudes from a lower surface of the fan case.

* * * * *